US005242665A

United States Patent [19]

Maeda et al.

[11] Patent Number: 5,242,665

[45] Date of Patent: * Sep. 7, 1993

[54] CARBON CONTAINING COMPOUND TREATING APPARATUS WITH RESISTANCE TO CARBON DEPOSITION

[75] Inventors: Keikichi Maeda; Naohiko Kagawa; Kunio Ishii, all of Yokohama; Takahiro Iijima, Tokyo, all of Japan

[73] Assignee: JGC Corporation, Tokyo, Japan

[ * ] Notice: The portion of the term of this patent subsequent to Dec. 11, 2007 has been disclaimed.

[21] Appl. No.: 937,436

[22] Filed: Aug. 28, 1992

Related U.S. Application Data

[63] Continuation of Ser. No. 599,492, Oct. 17, 1990, abandoned, which is a continuation-in-part of Ser. No. 56,218, May 29, 1987, Pat. No. 4,976,932.

[30] Foreign Application Priority Data

Jul. 23, 1986 [JP] Japan ..... 61-174160

[51] Int. Cl.[5] ..... B01J 19/02

[52] U.S. Cl. ..... 422/240; 422/7; 422/129

[58] Field of Search ..... 422/7, 219, 240, 129

[56] References Cited

U.S. PATENT DOCUMENTS 4,532,109 7/1985 Maeda et al. ..... 422/240
4,976,932 12/1990 Maeda et al. ..... 422/240

FOREIGN PATENT DOCUMENTS 1078775 3/1960 Fed. Rep. of Germany .

OTHER PUBLICATIONS

Metals Handbook, 8th Edition, vol. 1 (1972) p. 581.
The Condensed Chemical Dictionary, Tenth Edition, (1984) pp. 572, 969.
Perry's Chemical Engineers' Handbook, Sixth Edition (1986) pp. 23-39 thru 23-48.

*Primary Examiner*—Jill A. Johnston
*Attorney, Agent, or Firm*—Flynn, Thiel, Boutell & Tanis

[57] ABSTRACT

The surface of an apparatus made of a Fe base alloy or Ni base alloy containing at least 35 wt. % of Cr is resistant to carbon deposition when the apparatus contacts carburizing/oxidizing atmospheres.

5 Claims, 3 Drawing Sheets

Comparison of carbon deposition curves

CARBON CONTAINING COMPOUND TREATING APPARATUS WITH RESISTANCE TO CARBON DEPOSITION

This application is a continuation of U.S. Ser. No. 07/599,492, filed Oct. 17, 1990 and now abandoned, which is a continuation-in-part of U.S. Ser. No. 07/056,218, filed May 29, 1987 and now U.S. Pat. No. 4,976,932.

BACKGROUND OF THE INVENTION (a) Field of the Invention

The present invention relates to an apparatus for treating (causing a chemical reaction or merely heating) carbon containing compounds such as hydrocarbons or their derivatives or carbon monoxide or the like at temperatures higher than about 500° C.

(b) Description of the Prior Art

As the materials for constructing the above mentioned apparatus for treating carbon containing compounds, steels and Ni alloys have usually been largely used. Therefore, carbon deposition frequently occurs on the portions exposed to the high temperature fluid of carbon containing compounds in heater tubes, piping, fractionators, heat exchangers and the like during operation. Accordingly, various operational ill effects such as rise in $\Delta P$, reduction in heating efficiency and the like are often caused, thereby making it necessary to perform so-called decoking very frequently. It may be said that this decoking operation impedes the steady running of the apparatus and further acts not only to aggravate the economy of the process but also to exert various disadvantages upon the construction materials of the apparatus.

Cr is normally added to the construction materials of these apparatuses, namely steels or Ni alloys, from the viewpoint of corrosion resistance. The Cr contents thereof are less than 28 wt. %, where the Cr contents of the usual heat resisting steels and alloys are about 25 wt. %. Because of this, a protective oxide film such as $Cr_2O_3$ film is formed on the surface of these materials in the initial stage. However, since the operating environment comprises a carburizing/oxidizing atmosphere with thermal cycles in the actual apparatus, the Cr contained just beneath the surface is consumed sooner or later thereby causing deterioration of the material surface for this level of Cr content. Consequently, oxides of Fe and Ni such $Fe_2O_3$, NiO (or spinel oxides such as $NiFe_2O_4$, $FeCr_2O_4$, $NiCr_2O_4$ and the like) and so forth appear on the outer surface. These oxides of Fe and Ni are easily reduced by carbon containing compounds into metallic Fe and Ni, thereby causing carbon deposition.

According to the report of Lobo and others (Preprint for the 5th International Congress on Catalysis, Amsterdam (1972)), it is concluded that carbon deposition is caused by the transition metal elements, such as Fe, Co, Ni and the like, and the said carbon deposition is continued by their atoms and metal particles ceaselessly appearing, as if floating, on the upper surface of the carbon deposit layer.

Since it is actually proved by the present inventors' investigation that according to their analyses of the coke deposited on the inner surface of the member of the apparatus, transition metal elements such as Fe, Ni and the like can be detected, it is conjectured that carbon deposition is attributable to the supply of transition metal elements such as Fe, Ni and the like, brought about by reduction of the oxide containing Fe, Ni and the like as its constituent elements on the inner surface of the member or by diffusion of said elements through the surface oxide layer from the interior of the member wall.

In order to prevent carbon deposition in these apparatuses, various investigations have been carried out. For instance, it is reported in "Ind. Eng. Chem. Proc.-Design and Development. 8 [1] (1969) 25 by B. L. Crynes, L. F. Albright" that carbon deposition in ethylene producing apparatus can be somewhat suppressed by adding a very small amount of $H_2S$ to the feed, and some processes are employing this. However, the fact is that since the inside of the cracking tube member used in an ethylene producing apparatus or the like is under an extreme oxidizing atmosphere from the very beginning, it is difficult to sulfurize the metal surface and so sufficient effects are not achieved. In addition, some methods of preventing carbon deposition by utilizing an Al and/or Al oxide layer or film have been proposed whereby said layer or film covers the transition metals which promote carbon deposition such as Fe and Ni contained in the material in order to prevent those metal elements from contacting directly with carbon containing substances. Among them are the idea of hot-dipping the surface of the construction material with Al melt (U.S. Pat. No. 3,827,967) or calorizing (diffusing and penetrating Al) the surface of the construction material (L. F. Albright et al : "Thermal Hydrocarbon Chemistry", ACS Adv. Chem. Ser. 183; M. Papapietro et al: "Symposium on Coke Formation on Catalysts in Pyrolysis Units", ACS New York Meeting, Aug. 23-28 (1981) 723), and the apparatus with resistance to carbon deposition which comprises forming an Al oxide film on the Al increased surface of the construction material which has previously been alloyed with Al to such an extent that the material preserves its ductility and further has been enhanced in Al content by aluminizing its surface (Japanese Laid Open Patent Application 25386/1982).

However, these proposals still include the undermentioned problems. Namely, although the outermost surface matter possesses a sufficient capability to prevent carbon deposition in the beginning, the effect is liable to diminish sooner or later, because the surface metallurgically deteriorates on account of the secondary diffusion of Al in long-term use at elevated temperatures under a carburizing/oxidizing atmosphere which is subject to thermal cycles. Also, alloy materials containing much Al are inadequate for use as tube materials, because they are too brittle at ambient temperatures.

SUMMARY OF THE INVENTION

The object of the present invention is to provide a treating apparatus which is capable of solving the aforesaid usual problems and including a member which can prevent the deterioration of material surfaces even in a carburizing/oxidizing atmosphere with thermal cycles, is also superior in mechanical properties, and further can exhibit superior resistance to carbon deposition for long periods of time by preventing the aforesaid transition metals from floating to the surface.

The present invention provides a treating apparatus with resistance to carbon deposition for treating carbon containing compounds such as hydrocarbons or their derivatives, carbon monoxide or the like at temperatures higher than about 500° C., wherein at least a member contacting with said carbon containing compounds at temperatures higher than about 500° C. is composed of any one of Fe base, Ni base and Co base alloys, or their mixed Fe—Ni, Fe—Co, Ni—Co and Fe—Ni—Co alloys, each containing at least 28 wt. % of Cr.

As is evident from the foregoing, the member constituting the apparatus used in the present invention is made by employing, as a base metal, Fe base, Ni base, Co base, or their mixed Fe—Ni, Fe—Co, Ni—Co or Fe—Ni—Co alloy, and adding thereto or alloying Cr in an amount of 28 wt. % or more which is in excess of the Cr content sufficient to give ordinary corrosion resistance.

Further, it is desirable from the practical point of view that the material for constructing the apparatus of the present invention should contain the following elements for more concrete composition.

(1) C: 0.6 wt. % or less

C contents in this range are definitely beneficial for promoting high temperature strength and lowering the melting point thereby improving castability, but since C has a tendency to combine with the Cr contained in the alloy, in the case where the C content is in excess of 0.6 wt. %, the solid solution Cr contained in the matrix becomes remarkabely reduced, whereby it becomes difficult to form a stable $Cr_2O_3$ film.

(2) Si: 3.0 wt. % or less

Si in this range of contents definitely improves oxidation resistance as well as Cr, but in the case where the Si contents are in excess of 3.0 wt. %, it is attended by such ill effects as that whereby sigma embrittlement is accelerated, weldability becomes worse and the like.

(3) Mn: 3.0 wt. % or less

Mn is an element forming $\gamma$-phase, which is stable at high temperatures, but in the case where its contents are in excess of 3.0 wt. %, it acts to lessen the oxidation resistance of the surface and accelerate surface deterioration.

(4) Nb, Ti, Zr: 3.0 wt. % or less

These elements readily form oxides and thus act to fix the C contained in the alloy, suppressing the precipitation of Cr carbides. In other words, these elements are effective for maintaining the solid solution Cr in the matrix to a high level, thereby improving the properties of the materials for constituting the apparatus of the present invention. The amount of 3.0 wt. % or less of each of these elements is sufficient for obtaining said effects to the full.

(5) W, Mo: 3.0 wt. % or less

These elements contained in this range act to improve the high temperature strength of the alloy by solid-solution hardening. However, where their contents are in excess of 3.0 wt. %, the oxidation resistance of the alloy is vitiated.

(6) Rare earth elements : 0–1.0 wt. % in total

These elements in this range act to enhance adhesion of a $Cr_2O_3$ film and resistance to carburization and oxidization. These elements in this range are definitely effective for improving the hot workability of the material, but in the case where this content exceeds 1.0 wt. %, the material becomes brittle and workability is adversely affected.

Suitable Cr contents while the elements as abovementioned have been added should be defined at 28–70 wt. %, because where the Cr contents are in excess of 70 wt. %, the material becomes brittle and workability is affected. In this connection, it is to be noted that additive elements other than Cr can be adopted or rejected optionally, and impurities such as P, S and the like are unavoidably contained in these alloy materials.

These materials for constructing the apparatus according to the present invention can be produced in optional forms by means of usual metallic material manufacturing processes such as casting, forging (hammering, rolling, extruding, drawing and so on), powder molding and the like. These materials may be used as single materials, or as composite materials such as clad, or as coating materials for metal spraying and the like.

DETAILED DESCRIPTION OF THE INVENTION

Figure 1:
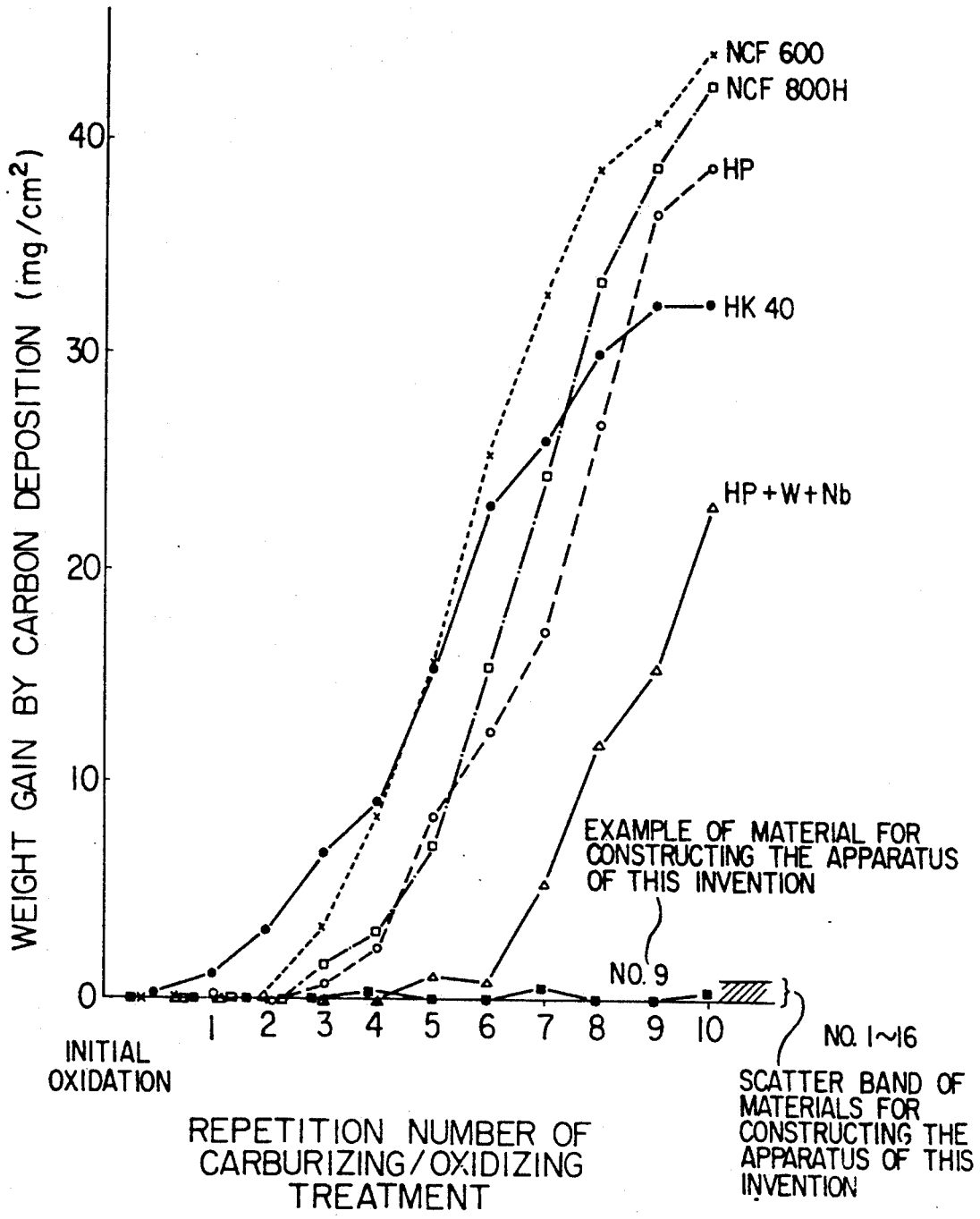
FIG. 1 is a graph showing the relationship between the number of repetitions of the carburizing/oxidizing treatment and the weight gain by carbon deposition in the example.

The term "carburizing/oxidizing atmosphere (environment)" used in the present invention (specification) means the atmosphere wherein generally one element is carbonized and another element is oxidized according to the carbon potential and the oxygen potential. The expression "the deterioration of material surface by carburization and oxidation" used in the present invention (specification) means the state wherein the protective oxide film is first deteriorated, carbon penetrates and diffuses into the interior of the member wall from the outer surface, consuming the Cr contained in the alloy, thereby forming Cr carbides. Therefore, the matrix depleted of Cr is easily oxidized, and thus corrosion progresses. In this case, the protectivity of the surface is lost, so that oxide layers consisting essentially of Fe and Ni become to be formed instead.

As apparatus to which the present invention is suitably applicable, the following can be enumerated: ethylene producing apparatus aiming at the production of light unsaturated hydrocarbons such as ethylene, propylene, and the like which comprises passing naphtha, ethane, gas oil, heavy oil or the like through the cracking tubes in the heating furnace provided together with steam at 750°–900° C. (fluid temperature); the piping system of delayed coking apparatus which involves preheating the vacuum distillation residue and the like within the heater tubes and coking them within the coking drum; styrene producing apparatus which consists of dehydrogenating ethylbenzene in the presence of steam at elevated temperatures; dealkylation apparatus of alkylbenzenes; and synthetic gas producing apparatus which consists of adding steam (in the case of a partial oxidation process, oxygen is added) to the feed hydrocarbons (methane, LPG, naphtha and the like) and heating them to produce carbon monoxide and hydrogen under the existence of catalysts: namely those apparatuses which are used for treating fluids containing hydrocarbons or their derivatives or carbon monoxide and include the parts exposed to elevated temperatures such as heating furnaces (cracking furnace, reactor furnace, preheating furnace), piping, fractionators, heat exchangers and the like where carbon deposition (including so-called "fouling", i.e. the agglomeration of carbonaceous substances occurring especially in heat-exchangers) has usually been a problem. As the material for the member which constitutes the apparatus and is exposed to high temperatures thereby causing the problem of carbon deposition, the base alloy is selected within the aforesaid range of the present invention depending on the situations and conditions for use in the treating apparatus.

As is evident from the aforegoing, since the materials for constructing the apparatus according to the present invention, even when said materials are Fe base, Ni base, Co base, or their mixed alloys, contain at least 28 wt. % of Cr, a firm $Cr_2O_3$ film, that is not easily deteriorated even under carburizing/oxidizing environments, is formed singly or in some cases accompanied by a $Cr_3C_2$ film or the like beneath it. This prevents transition metals such as Fe, Ni, Co and the like that function as catalyst for carbon deposition from floating and exposing themselves on the outer surface. Because of this, even when base alloys as mentioned above are employed, carbon deposition is prevented. In the present invention, furthermore, since the average Cr concentration of the whole range of alloys is fairly high, namely 28 wt. % or more, even if the Cr contained in the alloy adjacent to the surface is consumed for the formation of said $Cr_2O_3$ film, the matrix beneath the surface oxide film still contains sufficient Cr and is also supplied with Cr from the interior of the alloy by the aid of diffusion, whereby the Cr adjacent to the surface is not depleted by any possibility. Accordingly, the protective $Cr_2O_3$ film can be readily restored, and remain sound for long periods of time under a high temperature carburizing-/oxidizing environment, and so can maintain the effect of preventing carbon deposition.

In the usual chemical apparatuses for treating carbon containing compounds such as hydrocarbons or their derivatives, or carbon monoxide at high temperatures, carbon deposition and deterioration of the materials caused by carburizing/oxidizing atmospheres have always been problems.

In contrast with this, the present invention as mentioned above can achieve the following effects:

1. The frequency of decoking operation is reduced, and more continuous and stable running is ensured. Therefore, manufacturing efficiency is elevated.

2. The rise in $\Delta P$ accompanied by carbon deposition is reduced. Therefore, the running conditions are stabilized.

3. In the tubes of the heating furnace, the insulating effect caused by carbon deposit on the inside surface of the tubes is mitigated. Due to this, heating of the fluid inside the tubes can be maintained without the need to elevate the tube wall temperature too much. Thus the fuel can be economized and, further, the design temperature of the tube material can be comparatively low.

4. The decoking cost can be reduced by curtailing the utilities and personnel expenses required for decoking.

5. The deterioration of construction materials caused by carburization and oxidation can be avoided. Therefore, the life of the apparatus, including the lives of the parts such as tubes, is expected to be prolonged.

Examples of the present invention is given hereinafter.

EXAMPLE 1

Carburizing/oxidizing treatment was repeated on the test materials to accelerate deterioration of the material surfaces. The carbon depositing tendency of the material surface was measured at each interval of the carburizing/oxidizing treatment on laboratory tests. The results obtained are shown below.

(1) Test materials

Each of the various metallic materials according to the present invention shown in Table 1 (No. 1–16) was vacuum melted into a 50 $\phi \times 100$ 1 (mm) ingot. Plate-like test pieces ($5 \times 12 \times 42$ (mm) ) were cut from this ingot. The surfaces of these test pieces were polished with #120 emery paper. Thereafter, these test pieces were submitted to the test. Some commercially available alloys (cast and wrought) were also tested likewise for comparison.

(2) Test method

The test piece was placed in the center of a quartz tube having an inside diameter of 20 mm, an outside diameter of 25 mm and a length of 1 m, and same was set in the center of a tubular electric furnace of 65 cm in length and subjected repeatedly to the carburizing/oxidizing treatment under the undermentioned conditions, flowing feed gases from one end and exhausting said gases from the other end. The carbon deposition evaluation test was performed under different conditions from those for the carburizing/oxidizing treatment by means of the same apparatus, and carbon depositing tendency of the material was estimated from the values obtained by dividing the change in weight of each test piece before and after said test by the geometric area of each test piece.

A. Carburizing/oxidizing treatment

① Initial oxidizing treatment (In the actual apparatus, steam alone is first fed) steam: 2.0 g/hr, 950° C. × 1 hr ② Carburizing/coking treatment Ethylene 1.0 g/hr + Steam 0.5 g/hr, 1000° C. × 72 hr ③ Oxidizing/decoking treatment Air: 800° C. × 3 hr B. Carbon deposition evaluation test Benzene: 0.5 g/hr Argon (carrier gas): 16 Nml/min.

Reaction temperature and time: 800° C. × 3 0 hr (3) Test results

Figure 2:
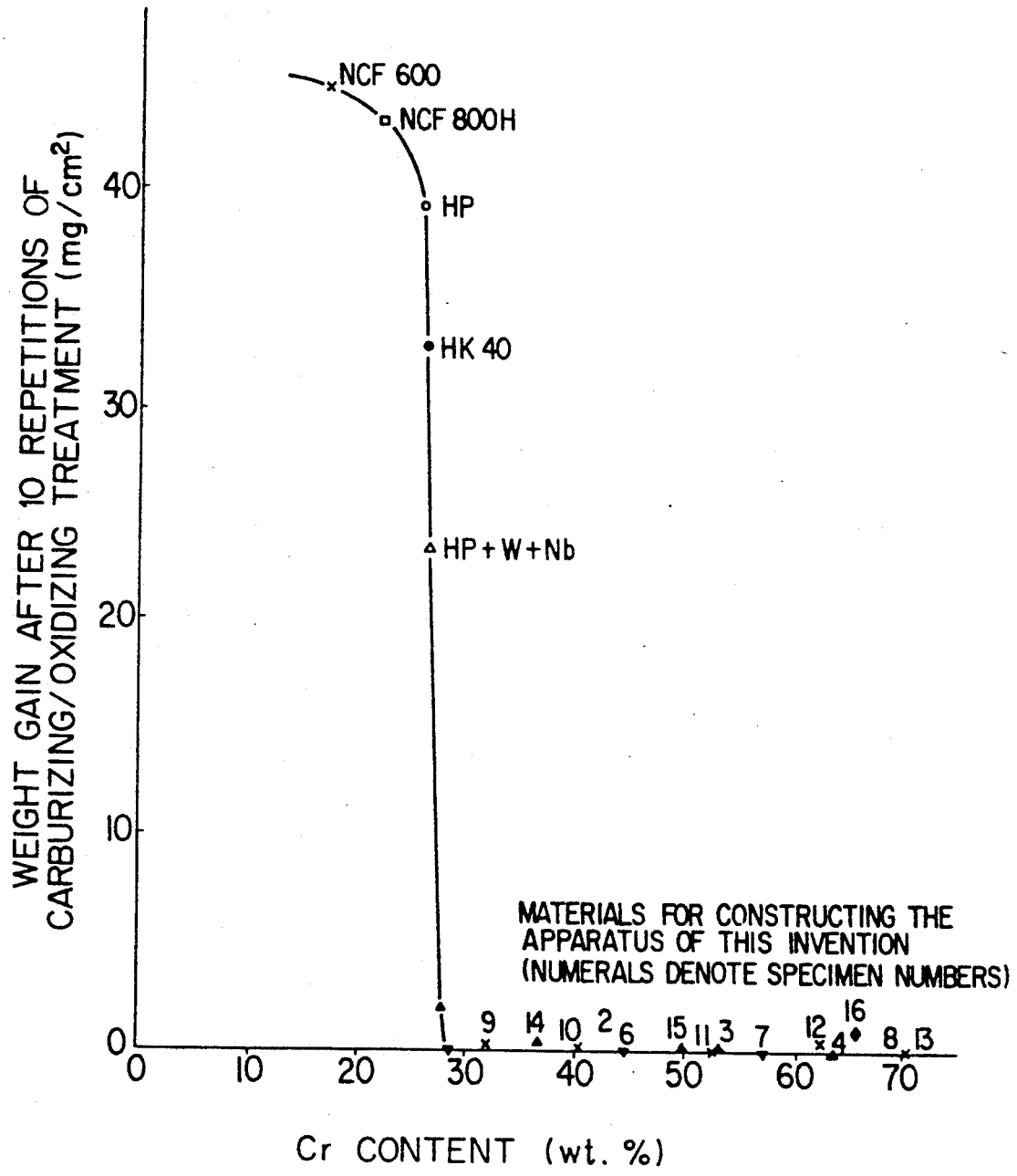
FIG. 2 is a graph showing the relationship between the Cr contents of the materials and the weight gain by carbon deposition after 10 repetitions of the carburizing/oxidizing treatment.

The carbon deposition evaluation test results obtained at each interval of repeated carburizing/oxidizing treatment are shown in FIG. 1. Further, the relationship between the results of carbon deposition test (weight gain by carbon deposition) after 10 repetitions of carburizing/oxidizing treatment and the original average Cr contents of the tested alloys is shown in FIG. 2. In addition, the maximum carburized depths of the test pieces observed by microscope and the amounts of weight reduced by carburization and oxidation of the test pieces are shown in Table 2.

It is proved from the abovementioned test results that the commercially available heat resisting alloys (steels) whose Cr contents are less than 28 wt. % are defective in that the surfaces are gradually deteriorated when subjected to repeated carburizing/oxidizing treatment and carbon deposition occurs more easily caused, whilst the materials for constructing the apparatus of the present invention, which contain at least 28 wt. % of Cr, do not deteriorate even when subjected to more than 10 repeated carburizing/oxidizing treatment and can prevent carbon deposition for long periods of time.

TABLE 1

| Material (Specimen number) | Chemical composition (weight %) | | | | | | | | | | | | | |
|---|---|---|---|---|---|---|---|---|---|---|---|---|---|---|
| | Cr | Fe | Ni | Co | C | Si | Mn | Nb | Ti | Zr | W | Mo | Al | Misch metal |
| Materials for constructing the apparatus of this invention | | | | | | | | | | | | | | |
| 1 | 28.12 | Balance | — | — | 0.07 | 1.02 | 1.48 | — | 2.39 | — | — | 0.52 | 0.52 | — |
| 2 | 41.78 | Balance | — | — | 0.07 | 1.04 | 1.47 | — | — | 1.57 | — | 0.49 | 0.48 | — |
| 3 | 52.51 | Balance | — | — | 0.08 | 1.12 | 2.03 | 1.53 | — | — | 1.02 | 0.57 | — | — |
| 4 | 63.44 | Balance | — | — | 0.07 | 1.08 | 2.16 | — | — | — | — | 0.63 | — | — |
| 5 | 29.02 | — | Balance | — | 0.11 | 1.03 | 1.07 | — | 1.83 | — | — | 1.11 | 0.62 | Addition 0.05 |
| 6 | 44.67 | — | Balance | — | 0.13 | 1.15 | 1.28 | — | — | 1.48 | — | 1.08 | 0.67 | Addition 0.05 |
| 7 | 56.82 | — | Balance | — | 0.16 | 1.22 | 2.57 | 1.90 | — | — | — | — | — | — |
| 8 | 69.19 | — | Balance | — | 0.14 | 1.20 | 2.49 | — | — | — | 1.53 | — | — | — |
| 9 | 32.38 | Balance | 30.09 | — | 0.24 | 1.52 | 1.01 | — | — | 2.07 | — | 0.43 | — | Addition 0.08 |
| 10 | 40.52 | Balance | 31.38 | — | 0.23 | 1.47 | 1.29 | — | — | 1.39 | — | — | — | Addition 0.08 |
| 11 | 52.14 | Balance | 15.67 | — | 0.37 | 1.53 | 2.51 | 1.48 | 1.20 | — | 1.58 | 0.58 | — | — |
| 12 | 61.93 | Balance | 14.99 | — | 0.32 | 1.48 | 2.63 | — | — | — | — | — | — | — |
| 13 | 69.94 | Balance | 15.25 | — | 0.33 | 1.60 | 2.57 | 2.26 | — | — | — | — | — | — |
| 14 | 36.58 | Balance | 30.47 | 15.08 | 0.42 | 1.05 | 1.28 | — | — | — | 2.62 | 1.58 | — | — |
| 15 | 49.87 | — | Balance | 31.66 | 0.41 | 1.09 | 1.32 | — | — | — | 2.89 | 1.63 | — | — |
| 16 | 65.40 | — | — | Balance | 0.56 | 0.97 | 1.23 | — | — | — | 2.57 | 2.04 | — | — |
| Comparative Materials | | | | | | | | | | | | | | |
| HK40 | 25.38 | Balance | 21.04 | — | 0.42 | 1.42 | 1.23 | — | — | — | — | 0.15 | — | — |
| HP | 25.23 | Balance | 35.41 | — | 0.51 | 1.36 | 1.37 | — | — | — | — | 0.21 | — | — |
| HP + W + Nb | 26.11 | Balance | 36.57 | — | 0.48 | 1.52 | 1.40 | 1.53 | — | — | 1.07 | 0.33 | — | — |
| NCF800H | 21.20 | Balance | 32.60 | — | 0.08 | 0.83 | 0.97 | — | 0.57 | — | — | — | 0.34 | — |
| NCF600 | 16.39 | 7.55 | Balance | — | 0.09 | 0.38 | 0.75 | — | — | — | — | — | — | Cu 0.28 |

TABLE 2

| Material (Specimen number) | Maximum carburized depth (μm) | Amount of reduced weight (mg/cm$^2$) |
|---|---|---|
| Materials for constructing the apparatus of this invention | | |
| 1 | 320 | 10.2 |
| 2 | 260 | 6.8 |
| 3 | 120 | 3.4 |
| 4 | 70 | 2.7 |
| 5 | 110 | 3.2 |
| 6 | 90 | 3.0 |
| 7 | 50 | 1.6 |
| 8 | 20 | 0.8 |
| 9 | 170 | 4.5 |
| 10 | 140 | 3.2 |
| 11 | 60 | 1.6 |
| 12 | 130 | 3.8 |
| 13 | 40 | 1.4 |
| 14 | 210 | 6.0 |
| 15 | 150 | 3.2 |
| 16 | 240 | 6.7 |
| Comparative materials | | |
| HK40 | 1,250 | 89.5 |
| HP | 870 | 57.8 |
| HP + W + Nb | 430 | 29.6 |
| NCF800H | 960 | 63.5 |
| NCF600 | 1,1780 | 78.3 |

According to the invention, there is also provided an apparatus with resistance to carbon deposition, for treating carbon-containing compounds at a temperature of higher than about 500° C. wherein a surface of said apparatus contacts a carburizing/oxidizing atmosphere, in which said surface of said apparatus is made of a metallic material consisting of a Fe base alloy or Ni base alloy, said metallic material containing an amount of chromium in the range of from 35 to 70 wt. % and effective to maintain a stable $Cr_2O_3$ film on said surface of said apparatus during contact with said carburizing-/oxidizing atmosphere.

EXAMPLE 2

Two types of centrifugally cast stainless steels and three types of hot extruded stainless steels were prepared for further detailed investigation of the effect of chromium content on their resistance to coke formation. Table 3 shows the chemical composition of the steels tested.

TABLE 3

| | Chemical compositions of the steel tested | | | | | | | | units: wt. % |
|---|---|---|---|---|---|---|---|---|---|
| | C | Si | Mn | P | S | Cr | Ni | Nb | W |
| 23CR—35Ni—Nb, W | 0.41 | 1.65 | 0.87 | 0.011 | 0.008 | 26.34 | 34.57 | 1.29 | 0.66 |
| 25Cr—35Ni | 0.40 | 1.02 | 1.00 | 0.011 | 0.013 | 26.53 | 34.17 | — | — |
| 25Cr—38Ni* | 0.13 | 1.82 | 1.00 | 0.014 | 0.002 | 24.64 | 37.74 | — | — |
| 35Cr—55Ni* | 0.02 | 0.23 | 1.02 | 0.010 | 0.001 | 35.49 | 55.16 | 0.25 | — |
| 40Cr—50Ni* | 0.02 | 0.21 | 1.22 | 0.011 | 0.001 | 39.81 | 51.96 | — | — |

Balance is Fe
*Hot extruded tubes. The others were centrifugally cast tubes.

These steels were subjected to repeated carburizing-/oxidizing treatments to promote the degradation of the surface of the samples similar to the surface degradation that actual cracking tubes may encounter. Subsequently, the carbon deposition evaluation tests were performed. Details of the test conditions are described below.

Figure 3:
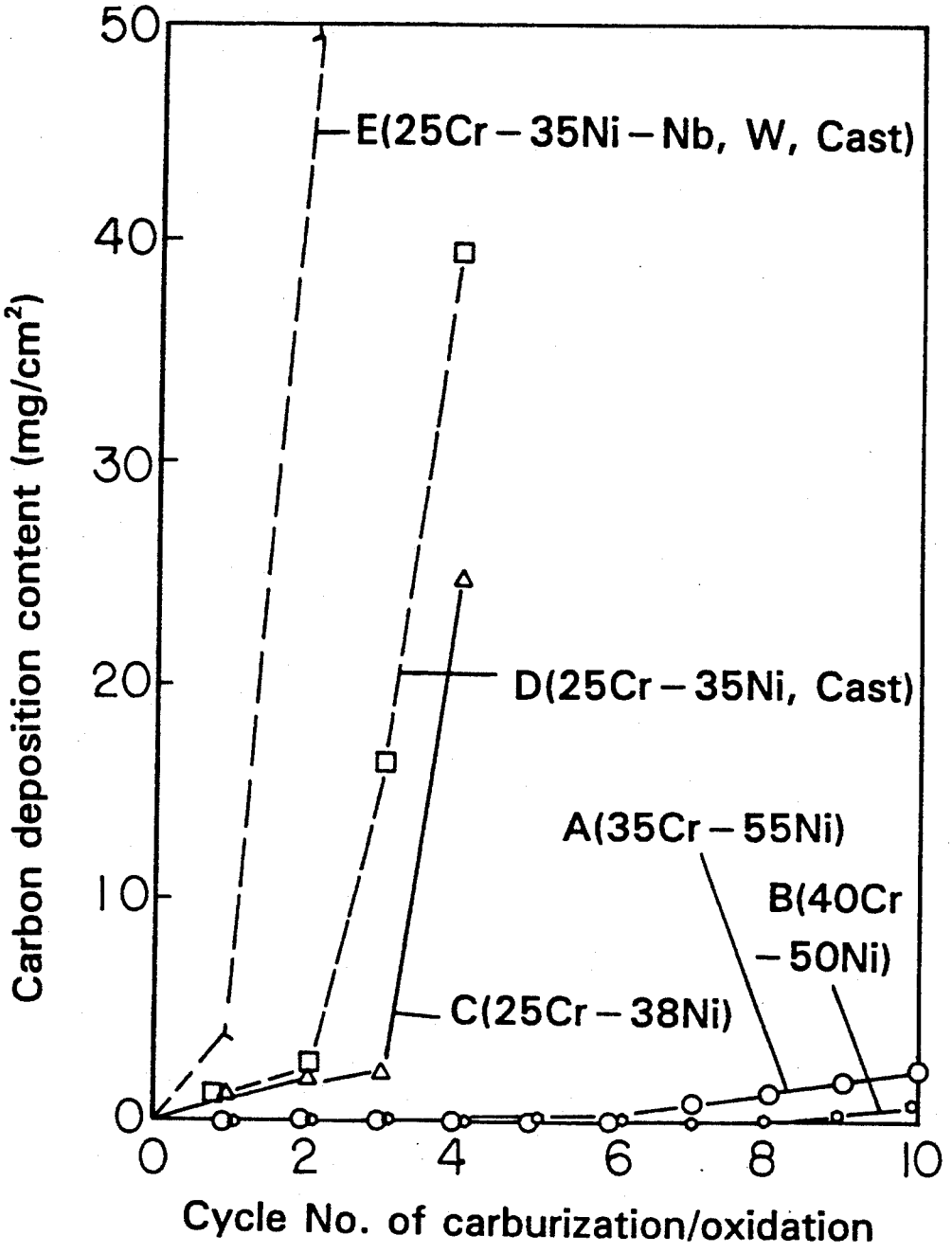
FIG. 3 is a graph showing the relationship between the number of repetitions of the carburizing/oxidizing treatment and the carbon deposition on the alloys of Example 2.

The results of the carbon deposition evaluation tests after repeated carburizing/oxidizing treatments, as well as the initial oxidation, are shown in FIG. 3.

As shown in FIG. 3, the amount of carbon deposited on the steels containing less than 35 wt. % of chromium increases as the number of repetitions of carburizing-/oxidizing treatments gets higher. However, steels which contain more than 35 wt. % chromium, and especially more than 40 wt. % of chromium, were reconfirmed to have resistance to carbon formation.

Carbon deposition evaluation tests (1) Test Materials

The various alloys set forth in Table 3 were vacuum melted and formed into ingots of 50 mm diameter and 100 mm length. Tabular test pieces of 5 mm thick, 12 mm wide and 42 mm long were cut out from these ingots and were subjected to the test after polishing of their entire surface with a #120 emery paper.

(2) Test Method

Each test piece was placed at the center of a quartz tube having an inside diameter of 20 mm, an outside diameter of 25 mm and a length of 10 cm. The quartz tube was placed at the center of an electric tubular oven having a length of 65 cm. A material gas was introduced from one end of the oven and discharged from the other end of the same. Using this testing apparatus, carburizing/oxidation treatments were cyclically conducted under the following conditions. A carbon precipitation test also was conducted under other conditions, using the same testing apparatus as described above. The carbon precipitation was evaluated in terms of the value obtained by dividing, by the geometrical area of the test piece, the amount of change in the weight of the test piece caused by the test precipitation.

A: Carburizing/oxidation promotion treatment

Test pieces were placed in a solid carburizing agent KG-30 at 1100° C. for 1 hour, thus effecting a carburizing/coking treatment. Subsequently, an oxidation/decoking treatment was conducted by maintaining the test piece in the atmospheric air at 1100° C. for 1 hour, followed by water quenching.

B: Evaluation of carbon precipitation performance

Each test piece was contacted with a gas (15 Nml/min) which was a mixture of benzene (0.5 g/hr) and argon (carrier gas) at a reaction temperature of 800° C. for 6 hours. Then, an oxidation/decoking was effected at 900° C. for 0.5 hour.

(3) Test Results

The results of evaluation of carbon precipitation in each cycle of repeated carburizing/oxidation treatments are shown in FIG. 3.

As will be understood from the test results, the test pieces of heat-resistant alloys having Cr contents below 35 wt. % are progressively degraded at their surfaces tending to cause carbon precipitation as a result of the repeated cycles of carburization/oxidation. In contrast, the material of the invention having a Cr content not less than 35 wt. % did not show any significant degradation despite the repeated cycles of carburization and oxidation, thus proving its ability to avoid precipitation of carbon for a long time.

What is claimed is:

1. An apparatus with resistance to carbon deposition, for treating carbon-containing compounds at a temperature of higher than about 500° C. wherein a surface of said apparatus contacts a carburizing/oxidizing atmosphere, in which said surface of said apparatus is made of a metallic material consisting of a Ni base alloy, said metallic material containing less than 0.67 wt. % Al and an amount of chromium in the range of from 35 to 70 wt. % and effective to maintain a stable $Cr_2O_3$ film on said surface of said apparatus during contact with said carburizing/oxidizing atmosphere.

2. An apparatus according to claim 1, wherein said member has been formed by casting, forging and/or powder molding.

3. An apparatus according to claim 1, which is for ethylene production, delayed coking, ethylbenzene dehydrogenation, dealkylating and/or synthetic gas production.

4. An apparatus, with resistance to carbon deposition, for treating carbon-containing compounds at a temperature of higher than about 500° C. in contact with a carburizing/oxidizing atmosphere, in which said apparatus is made of a metallic material consisting of a Fe alloy containing an amount of chromium in the range of from 35 to 70 wt. % and effective to maintain a stable $Cr_2O_3$ film on said apparatus during contact with said carburizing/oxidizing atmosphere, said Fe alloy consisting essentially of said chromium, up to 0.6 wt. % of C, up to 3.0 wt. % of Si, up to 3.0 wt. % of Mn, up to 3.0 wt. % of Nb, up to 3.0 wt. % of Ti, up to 3.0 wt. % of Zr, up to 3.0 wt. % of W, up to 3.0 wt. % of Mo, up to 1.0 wt. %, in total, of rare earth elements, and the balance is essentially Fe, said Fe alloy being substantially free of Ni.

5. An apparatus as claimed in claim 4 in which said Fe alloy contains from about 1.02 to about 1.12 wt. % of Si.

* * * * *